United States Patent [19]

Loison

[11] 3,955,758

[45] May 11, 1976

[54] CENTRIFUGAL SEPARATING APPARATUS

[76] Inventor: Robert Loison, 86, route de Mantes, 78200 Buchelay, France

[22] Filed: Apr. 22, 1975

[21] Appl. No.: 570,351

[30] Foreign Application Priority Data

Apr. 25, 1974 France ..... 74.14505

[52] U.S. Cl. ..... 233/20 R; 233/27; 233/46

[51] Int. Cl.[2] ..... B04B 1/14; B04B 11/04

[58] Field of Search ..... 233/19 R, 19 A, 20 R, 233/20 A, 27, 46, 47 R, 1 R

[56] References Cited

UNITED STATES PATENTS 3,823,869 7/1974 Loison ..... 233/20 R

*Primary Examiner*—George H. Krizmanich

*Attorney, Agent, or Firm*—Stevens, Davis, Miller & Mosher

[57] ABSTRACT

Centrifugal separating apparatus comprises a rotatable drum formed from at least two axially-spaced parts. The adjacent portions of adjacent parts have frusto-conical walls which co-operate to define a chamber which receives a component separated in the drum. The adjacent edges of the parts comprise lips which bound an outlet opening from the chamber and are operable for selectively closing the opening, for example by moving the lips together. A fluid lock chamber is formed in the lip structure between radially inner and outer lips for allowing discharge of a heavier product from the lock chamber while the lock chamber is itself isolated from the lighter liquid in the centrifuge drum. The lips are actuated by electro-magnets and are connected to the rods which drive the lips. At least one of the lips is integral with a ring which is connected by tie-rods to a second ring of soft iron which forms an armature of the driving electro-magnet.

12 Claims, 9 Drawing Figures

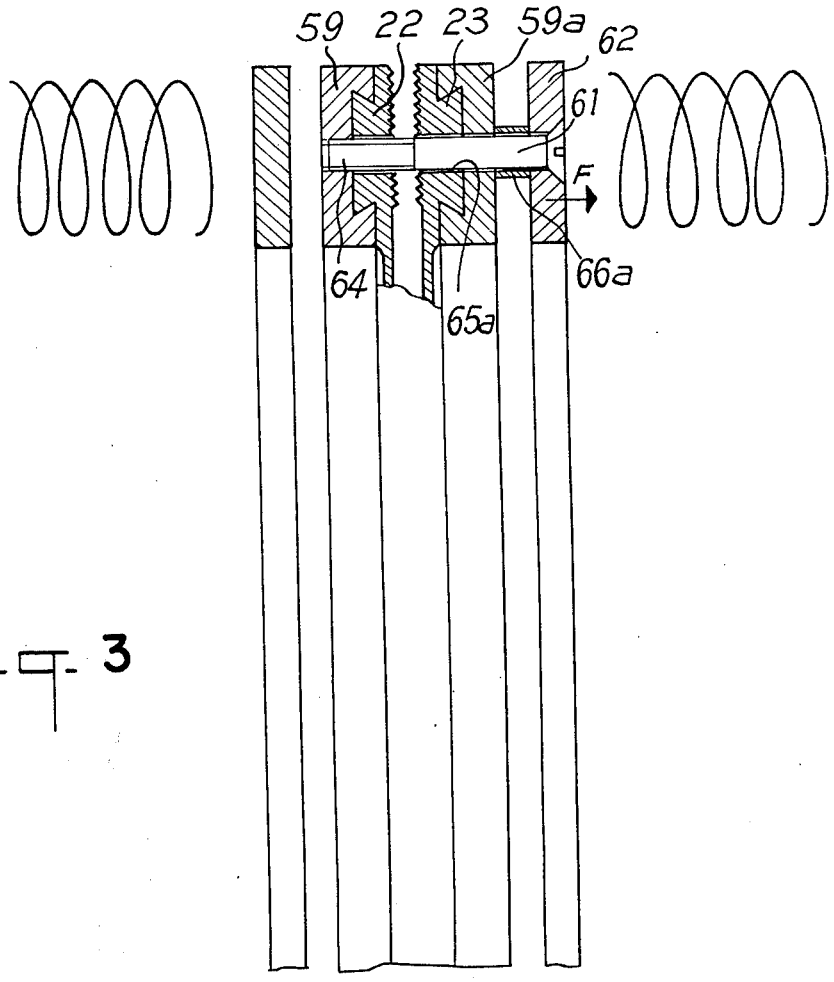
FIG. 3
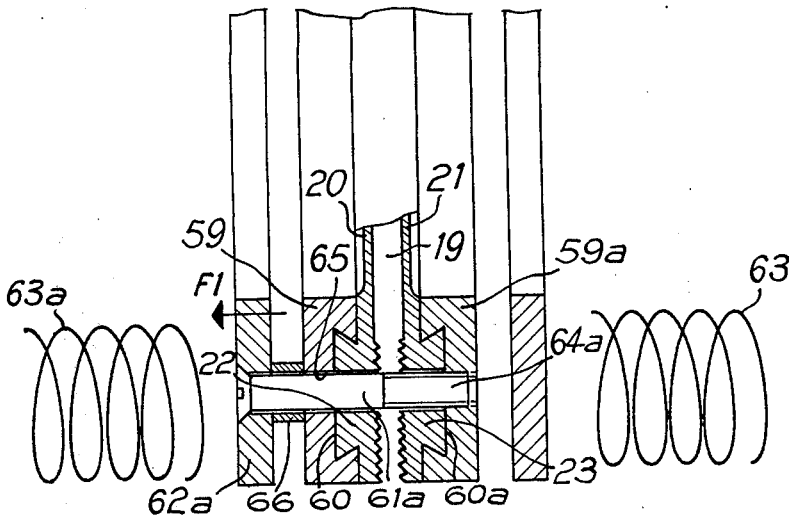

CENTRIFUGAL SEPARATING APPARATUS

BACKGROUND OF THE INVENTION

1. Field of the Invention

The present invention relates to centrifugal separating apparatus.

2. Description of the Prior Art

There has been proposed centrifugal separating apparatus for separating, for example, a liquid and a solid, or two different liquids, comprising a drum consisting of at least two parts having frusto-conical walls defining chambers for one of the separated components. In order to discharge this component from the chamber, one of the parts of the drum is axially displaceable so as to provide a circular outlet opening from the drum.

In this previously proposed apparatus, the parts of the centrifuging drum are made of a rigid material and the mechanism for displacing the parts of the drum is very complicated.

My earlier U.S. Pat. No. 3,823,869 issued July 16, 1974 discloses and claims a drum discharge arrangement comprising flexible lips at the spaced adjacent edges of components constituting the separator drum.

SUMMARY OF THE INVENTION

According to the present invention, there is provided in centrifugal separating apparatus, a rotatable drum, said drum comprising at least two parts, said parts having frusto-conical walls which cooperate to define a chamber to receive a component separated in the drum, the adjacent edges of the parts being spaced to define a circular outlet opening from the chamber, the said edges comprising two lips of a deformable material, each integral with a first ring connected by tie-rods to a second ring of soft iron which forms an armature of electro-magnet means for selectively bringing the lips into an open or a closed position.

According to the present invention, there is also provided in centrifugal separating apparatus, a rotatable drum, said drum comprising at least two parts having frusto-conical walls which co-operate to define a chamber in the peripheral portion of the drum, the adjacent edges of said parts being axially spaced to define an outlet from the chamber, said edges comprising lips lying on opposite sides of the outlet opening and being formed from a deformable material, means associated with the lips to selectively block the opening, and means defining a circular chamber between the first-mentioned chamber and the lips to form a lock for receiving one of the separated components.

BRIEF DESCRIPTION OF THE DRAWINGS

Embodiments of the invention will now be described, by way of example only, with reference to the accompanying diagrammatic drawings, in which:

FIG. 3 is a view in axial section of one embodiment of the means for controlling the lips;

DESCRIPTION OF THE PREFERRED EMBODIMENTS

Figure 1:
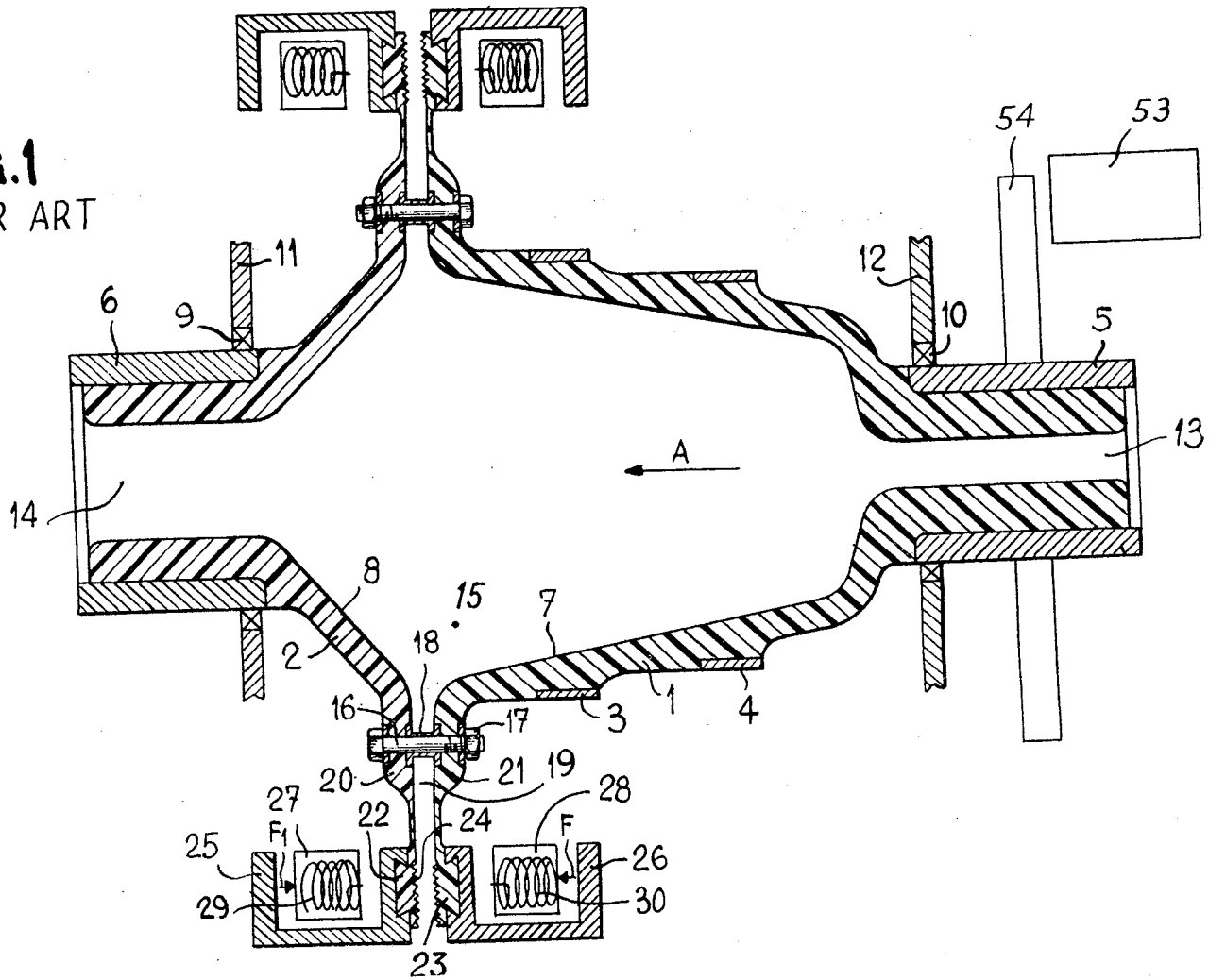
FIG. 1 PRIOR ART
FIG. 1 is a longitudinal section of centrifugal separating apparatus of the type disclosed in my said U.S. Pat. No. 3,823,869.

The centrifugal separating apparatus shown in FIG. 1 has a drum comprising two parts 1 and 2 made of a relatively deformable material. One of the parts, 1, is reinforced externally by bands 3 and 4, preferably metal bands, and the two parts 1 and 2 have at their end portions metal rings 5 and 6 rotatably mounted in support members 11 and 12 by means of ball bearings 9 and 10.

The material to be treated (for example a liquid) is introduced through an inlet 13 into the drum and is subjected therein to the action of centrifugal force which causes separation into an outer layer of a relatively heavy component, and an inner layer of a relatively lighter component.

The inner layer is withdrawn from the drum in the direction of the arrow A, through an outlet 14 whereas the outer layer consisting for example of a sediment or a different liquid accumulates in a peripheral chamber 15 defined by frusto-conical walls 7 and 8 of the parts 1 and 2 of the drum.

The parts 1 and 2 are joined together by a plurality of screws 16 provided with nuts 17 and distributed around the periphery of the parts: spacers 18 are interposed between the parts 1 and 2 so as to define a circular outlet opening 19 for the passage of the component accumulating in the chamber 15. The opposing edges 20 and 21 of the parts 1 and 2 have extensions in the form of deformable annular lips 22 and 23 which consist of the same material as the parts 1 and 2 and which are moulded integrally with those parts. The lips 22 and 23 are provided with grooves 24 and can lie in a spaced configuration (as shown in FIG. 1) or in a configuration in which they are in contact so as to block or close the circular opening 19.

The lips 22 and 23 are fast with annular members 25 and 26 respectively, the members 25 and 26 consisting of soft iron and constituting armatures capable of being attracted by cores 27 and 28 of annular coils 29 and 30 when the coils are energised by the passage of an electric current. When the members 25 and 26 are attracted by the cores of the coils 29 and 30 as indicated by the arrows F and $F_1$, the lips 22 and 23 come into contact and cause the circular opening 19 to be closed.

In the embodiments particularly described the drum 1, 2 is made of a plastics material, and the lips are formed integrally therewith; the drum can, however, be made of metal to which lips made of deformable material are attached.

The drum is preferably driven by a linear motor 53 (FIG. 1) which cooperates with a metal disc 54 rigid with the ring 5 provided at the end of the part 1. Alternatively, the drum can be driven by a conventional motor through a suitable transmission.

Figure 2:
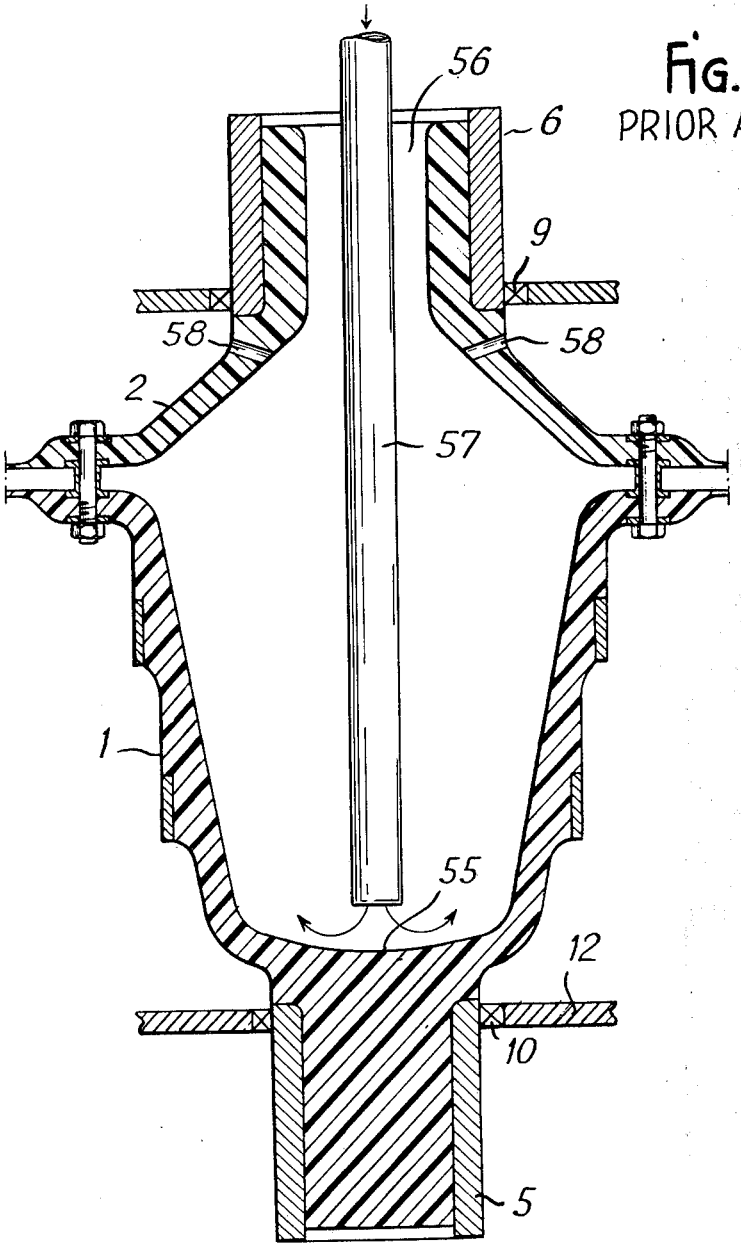
FIG. 2 PRIOR ART
FIG. 2 is a longitudinal section of another form of such centrifugal separating apparatus.

In the embodiment shown in FIG. 2, the drum may be rotatable about a vertical axis and is closed at its bottom 55. The material to be treated is introduced through an upper inlet 56 by means of a vertical duct 57 which leads to the bottom part of the drum. After a centrifugal separating action has been effected one of the components of the material (this component itself being a liquid) is evacuated through orifices 58 provided in the periphery of the upper part 2 of the drum.

The operating mechanism for the lips and the structure of the lips in the separating apparatus according to the present invention will now be described with reference to FIGS. 3 through 9.

In FIG. 3 there are shown the lips 22 and 23 defining the rims 20, 21 of the circular opening 19 provided between the two elements of a centrifuge drum. According to the present invention each of the lips 22, 23 of deformable material is integral with a first ring 59, 59*a* of rigid material which has a groove 60, 60*a* in which a lip 22, 23 is embedded.

The rings 59, 59*a* are respectively connected by tie-rods 61, 61*a* to a second ring 62, 62*a* of soft iron which forms an armature cooperating with a core of at least one electro-magnet coil 63, 63*a*. Each of the tie-rods 61, 61*a* is secured by its threaded portion 64, 64*a* in a tapped hole provided in the respective ring 59 or 59*a* and passes through an orifice 65 or 65*a* provided in the ring 59 or 59*a*. Spacers 66 and 66*a* engaged on the tie-rods 61*a* and 61 are provided between the rings 59 and 62*a* on the one hand and between the rings 59*a* and 62 on the other hand.

When the coils 63, 63*a* are electrically energised they exert an attraction on the rings 62 and 62*a* according to the arrows F, F1 in such manner that, through the intermediary of the tie-rods 61, 61*a*, the rings 59, 59*a* and the lips 22, 23 integral therewith are brought together towards the closed position of the circular opening 19.

It is important to note that in many cases users of centrifuges seek to obtain sediments which are as dry as possible, that is to say devoid of any liquid constituent.

Figure 4:
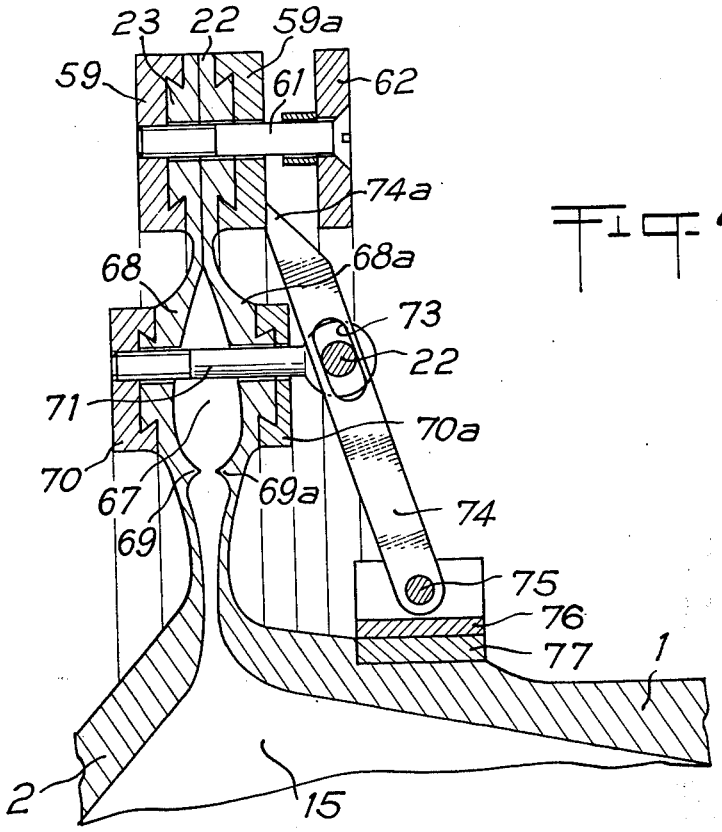
FIG. 4 is a sectional view of an embodiment of the circular chamber forming a lock.
Figure 5:
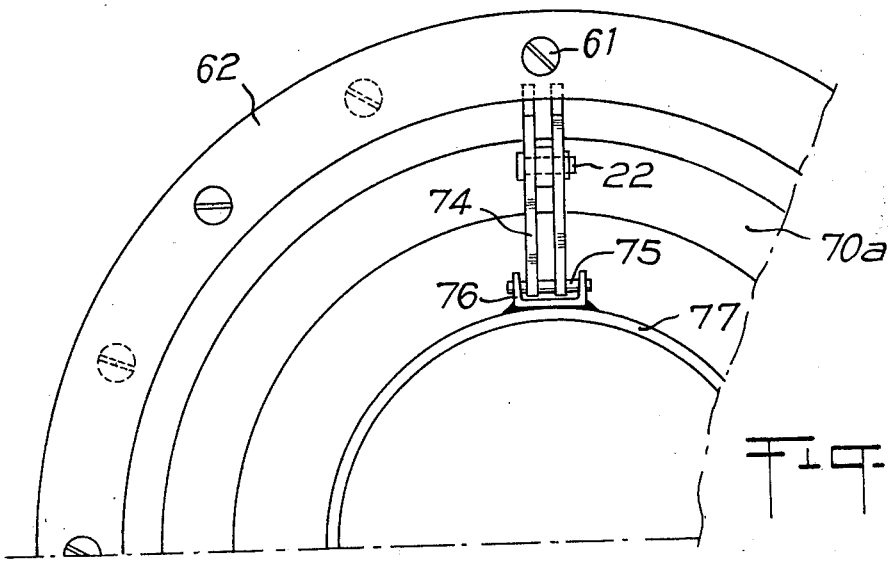
FIG. 5 is a side view of the device for controlling the annular chamber.

To this end the embodiment shown in FIGS. 4 and 5 has a circular chamber 67 forming a fluid lock between the receiving chamber 15 and the outer lips 22, 23. This chamber 67 enables the product obtained by centrifuging to be dried prior to discharge.

The circular chamber or lock 67 is defined by two deformable portions 68, 68*a* of the elements 1 and 2 of the centrifuge drum, and is bounded at one side by radially outer lips 22, 23 and at the other side by radially inner lips 69, 69*a* situated between the fluid lock chamber 67 and the receiving chamber 15 of the main centrifuging chamber.

The deformable portions 68, 68*a* are integral with two rings 70, 70*a* of rigid material, one of the rings 70 being integral with tie-rods such as 71 which have at their end a pivot pin 72 engaged in an elongate hole 73 of a lever 74 one end of which lever is articulated about a shaft 75 of a bracket 76 secured on a collar 77 mounted on one of the elements of the bowl, in this case element 1.

At its other end 74*a* the lever 74 bears on the ring 59*a* which is integral with one of the outer lips 23.

The device shown in FIGS. 4 and 5 operates in the following manner:

When the radially outer lips 22, 23 are closed as is shown in FIG. 4, the radially inner lips 69, 69I*a* are open so that the product present in the receiving chamber 15 will fill the circular fluid lock chamber 67.

When the chamber 67 is full the radially outer lips 22, 23 are opened under the effect of the electro-magnets as described above, and the lever 74 bearing on the ring 59*a* is caused to pivot about the shaft 75 while entraining the tie-rod 71 and hence the ring 70 to effect closing of the inner lips 69, 69*a*. In this position the product present in the chamber 67 is discharged via the opening provided between the lips 22, 23 when they are in open position.

Upon closing of the lips 22, 23 the opposite occurs and the radially inner lips 69 open.

Control of the radially inner lips 69, 69*a* could be effected as for the outer lips 22, 23 by separate electromagnetic devices identical to those of FIG. 3.

Other mechanically, hydraulically or pneumatically controlled devices could alternatively be employed.

For sensing the thickness of the layer of product it is also possible to use a sensing probe or a radiation sensing device operating on the radar principle. Similarly, control of the opening and closing of the lips may be subjected to a timed delay.

Figure 6:
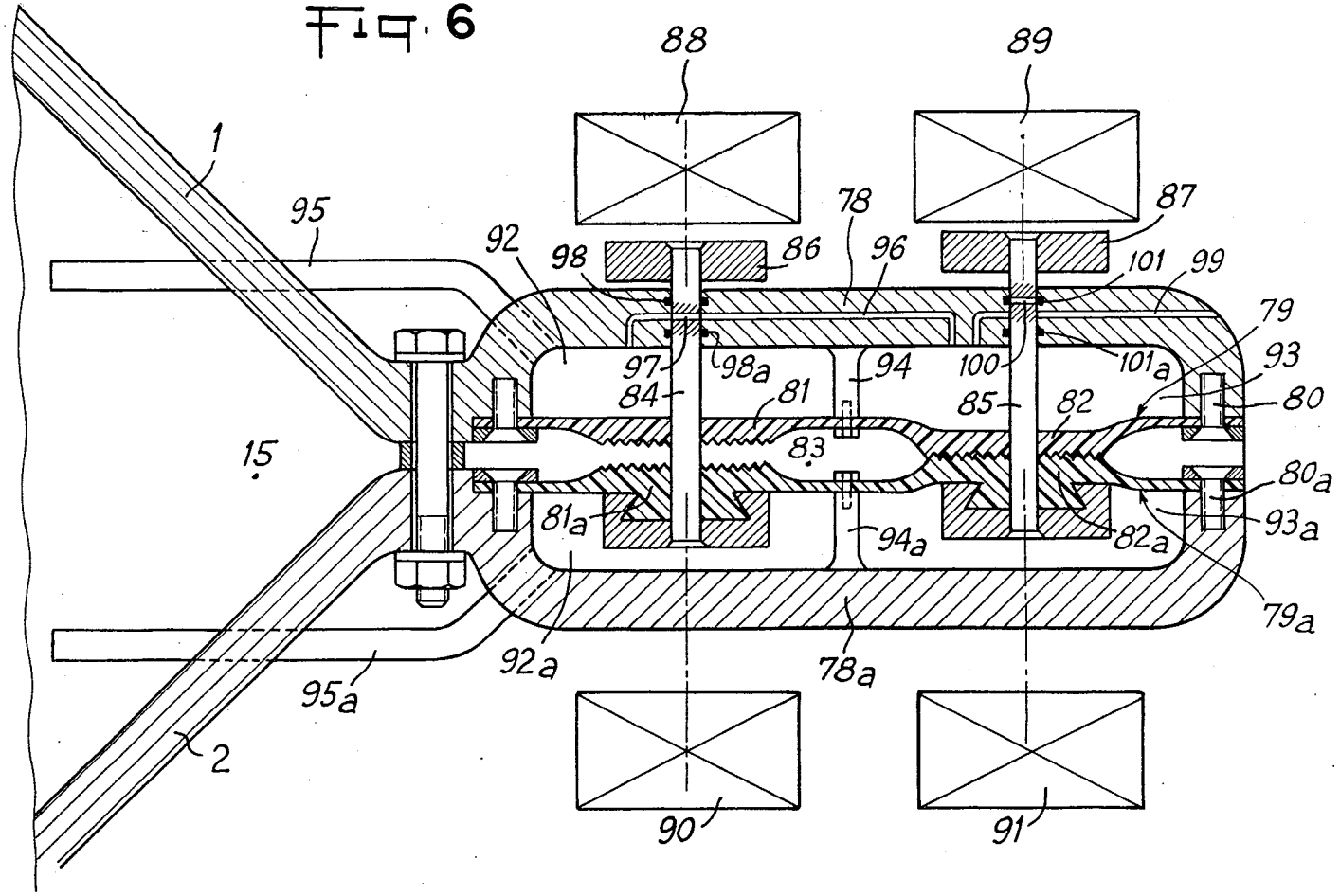
FIG. 6 is an axial sectional view of an embodiment of the compensation chamber containing two membranes defining the lock-forming chamber.
Figure 7:
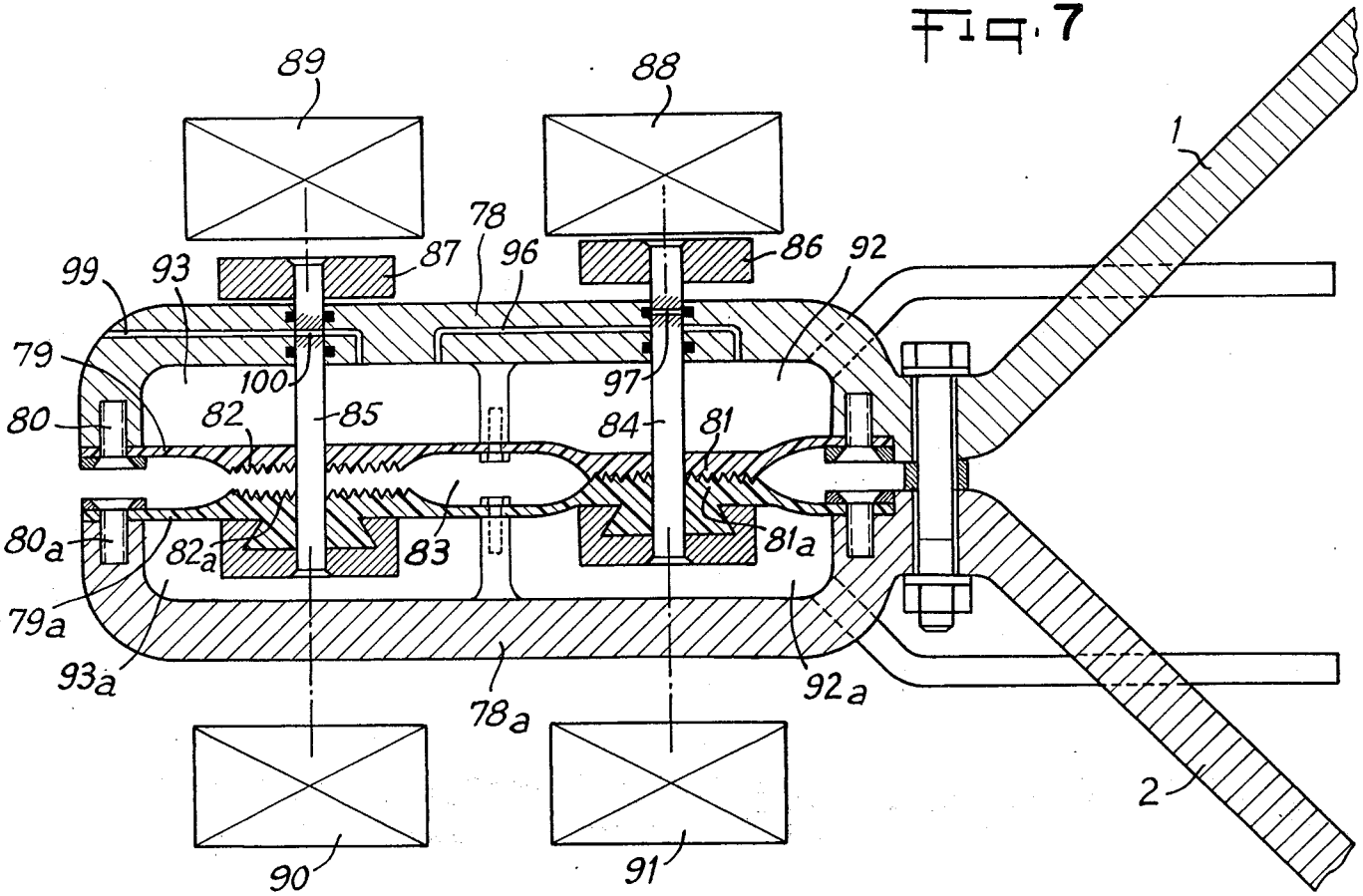
FIG. 7 is a similar view wherein the radially outer lips are in open position for the discharge of the product.

FIGS. 6 and 7 show an embodiment of the centrifuge comprising the two centrifuge elements 1, 2 extended at their peripheries by two circular chamber members 78, 78*a*, respectively, closed by two deformable membranes or diaphragms 79, 79*a* secured to the edges of said chamber members by means of screws 80, 80*a*.

The membranes 79, 79*a* have inner lips 81, 81*a* and outer lips 82, 82*a* which between them define a circular chamber or fluid lock 83 intended to receive the sediments for drying before their discharge.

The lips 81*a* and 82*a* are connected by rods 84, 85 to armatures 86, 87 which cooperate with electro-magnets 88, 89. In the same manner the lips 81, 82 are actuated by electro-magnets 90, 91 by connection means such as rods and armatures which are identical with those described above but not shown in the drawing.

The chamber members 78, 78*a* are internally divided into two compartments 92, 93 and 92*a*, 93*a* by partitions 94, 94*a* and they are placed in communication with the bowl of the separator apparatus via two conduits 95, 95*a* which ensure said chambers being fed with fluid under pressure consisting of the clear liquid.

It is clear that any other external source of fluid under pressure could be utilised with a device having rotary couplings.

Since the conduits 95, 95*a* open into the compartments 92, 92*a*, means are provided for communicating the compartments 92 and 92*a* with the compartments 93 and 93*a* and for discharging fluid from the compartment 93, 93*a*. For this purpose a conduit 96 connects the compartments 92, 93 through an orifice 97 provided in the control rod 84, sealing about the rod 84 being ensured by O-rings 98, 98*a*.

Furthermore, the compartment 93 is connected via a conduit 99 to some kind of fluid collecting vessel through an orifice 100 provided in the control rod 85, sealing around the rod 85 being ensured by further O-ring seals 101, 101*a*.

The device operates as follows:

When the radially outer lips 82, 82*a* are closed as shown in FIG. 6 the lips 81, 81*a* are open so that the product present in the receiving or collection chamber 15 fills the circular chamber or fluid lock 83.

In this position the liquid fluid emanating from the conduits 95, 95*a* feeds the compartments 92, 92*a* and also the compartments 93, 93*a* since the compartments 92, 92*a* are connected thereto via the conduit 96 and the orifice 97. The compartments 93, 93*a* remain isolated from the collecting vessel by virtue of the fact that the orifice 100 in the control rod 85 is not aligned with the conduit 99.

When the fluid lock chamber 83 is full the radially outer lips 82, 82*a* are opened under the action of the radially outer electro-magnets 89, 91 (FIG. 4) while the inner lips 81, 81*a* are already closed by the action of the electro-magents 88, 90.

Product present in the chamber 83 is discharged via the opening provided between the radially outer lips 82, 82*a* when they are in open position.

Upon actuation of the two sets of lips the rods 84 and 85 are displaced as is shown in FIG. 4, such that the communication between the compartments 92, 92*a* and 93, 93*a* is interrupted because the orifice 97 in control rod 84 is no longer in line with the conduit 96.

On the other hand, the compartments 93, 93*a* are connected to the collecting vessel of unpressurised fluid via the conduit 99 and the orifice 100 in control rod 85.

Figure 8:
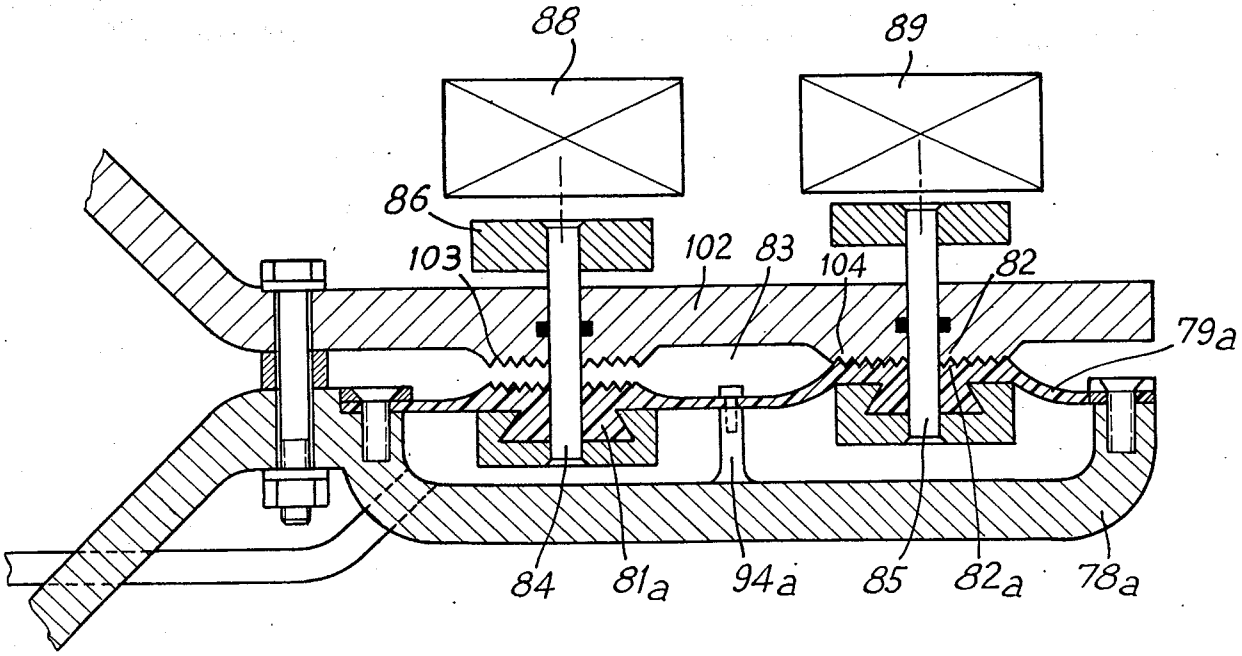
FIG. 8 is a view in axial section of a further embodiment comprising a single membrane and wherein the single radially inner lip is in open position.
Figure 9:
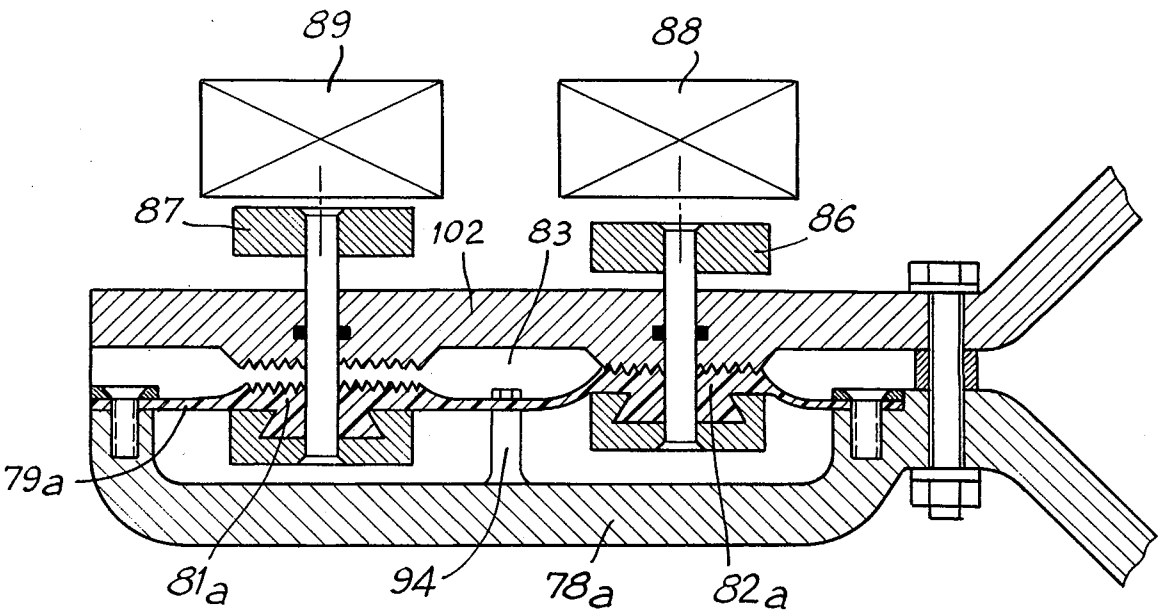
FIG. 9 is an axial sectional view similar to FIG. 8 and wherein the outer lip is in open position for the discharge of the product.

FIGS. 8 and 9 show a further embodiment using a single deformable membrane 79*a* having movable lips 81*a* and 82*a* which cooperate with a stationary plate 102 in which one part of the circular chamber 83 and counter members 103, 104 for the lips 81*a*, 82*a* have been fashioned.

The operation is the same as that described above for the device having two membranes.

I claim:

1. In centrifugal separating apparatus, a rotatable drum comprising:

a. at least two parts;

b. frusto-conical walls of said parts cooperating to define a chamber to receive a component separated in the drum, said parts having adjacent edges spaced apart to define a circular outlet opening from the chamber;

c. lips of deformable material at said edges of the parts;

d. first ring means integral with one of said lips;

e. second ring means of soft iron spaced from said first ring means;

f. electro-magnet means cooperating with said second ring means whereby said second ring means forms an armature of said electro-magnet means; and g. tie-rods connecting together said first and second ring means, whereby energisation of the electro-magnet means brings the lips selectively to an open or a closed position.

2. Apparatus as claimed in claim 1, including means defining orifices in said first ring means integral with one of the lips for receiving the tie-rods of the other lip, and spacer means provided on each of said tie-rods for spacing said first ring means from the second ring means to which said tie-rods are connected.

3. In centrifugal separating apparatus, a rotatable drum comprising:

a. at least two parts, b. frusto-conical walls of said parts cooperating to define a separating chamber to receive a component separated in the drum, said parts having adjacent edges spaced to define a circular outlet opening from said chamber, c. deformable lip means at said edges of said parts;

d. actuator means cooperating with said lip means to bring the lip means selectively into an open or a closed position, and e. means defining a circular chamber between the first-mentioned chamber and the lip means to form a lock chamber for receiving said one of the components separated in the drum.

4. Apparatus as claimed in claim 3, wherein said lip means comprise radially inner and radially outer lips spaced from one another in a radial direction; wherein said means defining the lock chamber comprise two deformable elements integral with said parts of the centrifuging drum; and wherein said lock chamber comprises a circular cavity bounded at one side by said radially outer lips of said drum and at the other side by said radially inner lips which separate said first-mentioned chamber from the lock chamber.

5. Apparatus as claimed in claim 4, and including two rings of magnetic material integral with said two deformable elements defining the lock chamber, and electromagnet means adapted to cooperate with said rings.

6. Apparatus as claimed in claim 4, including first ring means integral with one of said radially outer lips, second ring means secured to one of said two drum parts, a plurality of levers each having one end articulated to said second ring means and the other end bearing on said first ring means, a plurality of tie rods integral with one of the deformable elements defining the lock chamber, and means articulating each of said tie rods to a respective one of said levers between the ends of said respective lever.

7. Apparatus as claimed in claim 6, including a shaft carried by each tie rod, and means defining an elongate hole in each lever, each said shaft being engaged in the elongate hole in said respective lever.

8. Apparatus as claimed in claim 3, wherein said lip means comprise radially inner and radially outer lips spaced from one another in a radial direction, at least one of said radially inner lips being joined to at least one of said radially outer lips to define a deformable wall which constitutes the two movable lips and is movable towards and away from the other lips, and wherein said deformable wall includes means defining said lock chamber, and further including a compensation chamber integral with one of said parts of the centrifuging drum and disposed externally of said lock chamber to subject the lock chamber to the action of a fluid disposed in said compensation chamber.

9. Apparatus as claimed in claim 8, and including a compartment in said compensation chamber, and means for communicating said compartment to a source of fluid under pressure.

10. Apparatus as claimed in claim 8, and including a plurality of compartments of said compensation chamber, and distribution means adapted to connect said compartments alternately to a source of fluid under pressure and to an unpressurized vessel.

11. Apparatus as claimed in claim 10, and including push rods movable to control said movable lips, and wherein said distribution means include conduits connecting said compartments of the compensation chamber with a source of fluid under pressure and with an unpressurized vessel, and orifices in said push rods adapted to connect said conduits in one extreme position of said push rods and to isolate said conduits in another position of said push rods.

12. Apparatus as claimed in claim 8, and including a conduit connecting said compensation chamber to the interior of said drum for supplying said compensation chamber with a liquid present in said drum.

* * * * *